US007212644B2

(12) United States Patent
Gavriliu et al.

(10) Patent No.: US 7,212,644 B2
(45) Date of Patent: May 1, 2007

(54) RESONANT FREQUENCY ADJUSTMENT USING TUNABLE DAMPING RODS

(75) Inventors: Marcel Gavriliu, Pasadena, CA (US); Tuomas Holmberg, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 773 days.

(21) Appl. No.: 09/681,728

(22) Filed: May 29, 2001

(65) Prior Publication Data

US 2002/0097887 A1 Jul. 25, 2002

Related U.S. Application Data

(60) Provisional application No. 60/207,642, filed on May 26, 2000.

(51) Int. Cl.
*H04R 25/00* (2006.01)

(52) U.S. Cl. ..... 381/353; 381/338; 381/354

(58) Field of Classification Search ..... 181/151, 181/166, 198, 207, 208, 210, 222; 381/338, 381/345, 346, 353, 354, 162, 71
See application file for complete search history.

(56) References Cited

U.S. PATENT DOCUMENTS

| | | | | |
|---|---|---|---|---|
| 3,555,187 | A * | 1/1971 | Rowley | 600/528 |
| 3,660,602 | A * | 5/1972 | Thompson | 381/114 |
| 4,805,221 | A * | 2/1989 | Quaas | 381/335 |
| 5,731,554 | A * | 3/1998 | Anagnos | 181/199 |
| 6,173,064 | B1 * | 1/2001 | Anagnos | 381/353 |

FOREIGN PATENT DOCUMENTS

DE 3818-552 A * 5/1988

* cited by examiner

*Primary Examiner*—Suhan Ni
(74) *Attorney, Agent, or Firm*—Fish & Richardson P.C.

(57) ABSTRACT

A mechanical device is tuned using a tunable damping rod. The tunable damping rod can have its tension increased between its respective engines, to in order to increase the resonant frequency of the mechanical device. Different aspects may also be included; the mechanical device may include a constrained layer damping material, which constraints certain mechanical vibrations. The tuning may tuned the mechanical device to reach that vibration.

3 Claims, 2 Drawing Sheets

RESONANT FREQUENCY ADJUSTMENT USING TUNABLE DAMPING RODS

CROSS REFERENCE TO RELATED APPLICATIONS

This application claims priority from application No. 60/207,642, filed May 26, 2000.

BACKGROUND OF INVENTION

A mechanical element may have at least one intrinsic resonant frequency. That resonant frequency may be in the audio range. Audio stimuli may therefore excite the mechanical element, and cause the mechanical element to react in some way. The reaction of the mechanical element may be undesirable. Moreover, since the effect of resonance may be highly amplified and exaggerated, this effect may become undesirable and especially problematic at resonance.

A remedy has been suggested to apply some sort of damping to such elements. Damping, however, works best at higher frequencies. In contrast, many of the resonances occur at lower frequencies. Hence, the damping has not been highly effective.

SUMMARY OF INVENTION

The present application teaches a special tunable damping system. The damping system may include a tunable damping rod. Tuning of the damping may become possible to prevent or minimize undesirable resonance.

BRIEF DESCRIPTION OF DRAWINGS

These and other aspects will now be described in detail with reference to the accompanying drawings, wherein.

DETAILED DESCRIPTION

Figure 1:
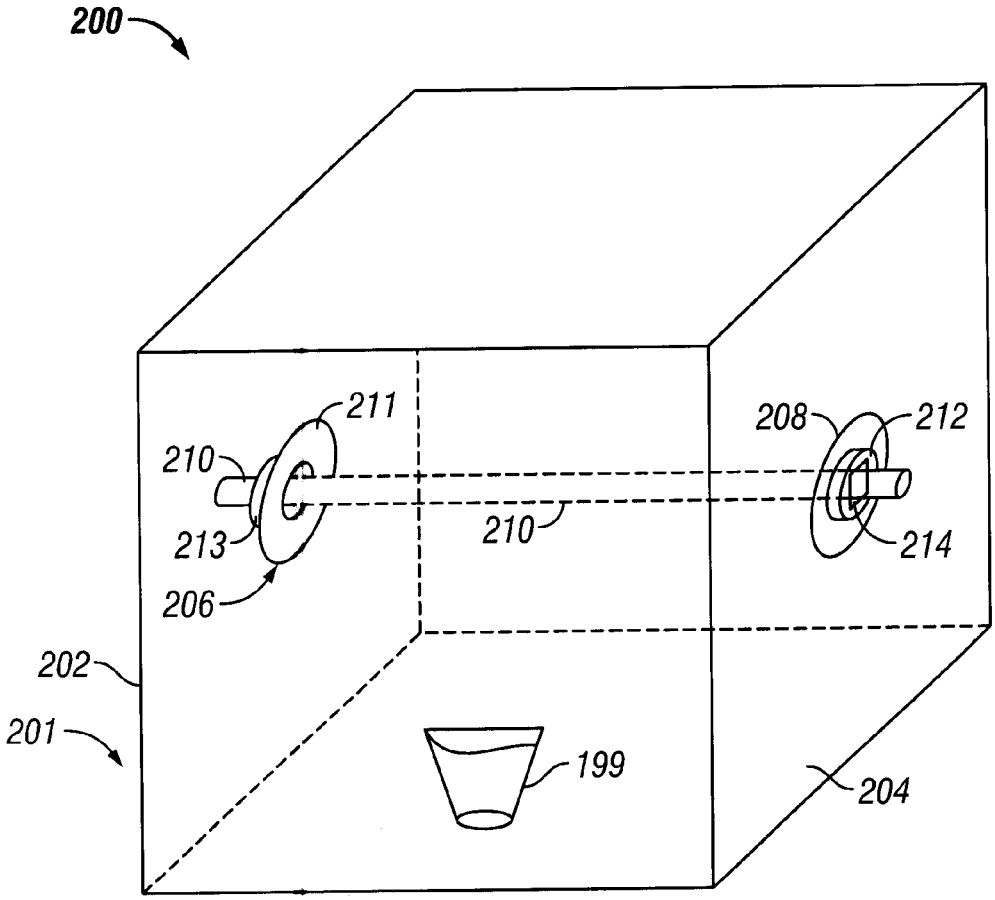
FIG. 1 shows an embodiment with a tunable damping rod applied to an enclosure.

A tunable damping rod is shown in FIG. 1 within a speaker enclosure. This tunable damping rod may increase the resonant frequency of a mechanical element. The tunable damping rod operates by applying tension to the part. The amount of tension may be variable using a screw operation. Moreover, since this system increases the resonant frequency, the efficiency of tuning may be improved.

In a loudspeaker enclosure, a moving speaker driver shown generically as 199 may excite undesirable resonance in the enclosure. Taking an example of a woofer, the moving woofer may excite undesirable resonance in the enclosure. This resonance may radiate from the cabinet walls as additional sound waves. The area of the enclosure walls are typically much larger than the area of the woofer. Hence, it even small resonance amounts may radiate audible sound levels. This extra sound may not be true to the music, and may be undesirable.

A tunable damping rod is used to eliminate enclosure resonance. In the embodiment shown in FIG. 2 the enclosure 200 has first and second parallel sides 202, 204. Holes 206, 208 are respectively formed in the sides 202, 204. A threaded rod 210 is placed through the holes to thereby extend from one end of the enclosure to the other. Washers 211, 212 are inserted on respective ends of the rod 210. Bolts 213,214 are then coupled over the washer, and are then tightened. The tightening of the bolts 213, 214 causes the washers 211,212 to be tightened against the enclosure walls 202, 204. This tightening operation builds up tension in the enclosure walls, causing them to bow slightly towards one another.

By tensioning the enclosure walls, the fundamental resonance of the enclosure is raised in frequency. This is analogous to the way in which a guitar string has its resonant frequency increased when tightened. Higher frequency resonances tend to decay faster than lower frequency resonances, and hence may be more difficult to excite. Accordingly, by increasing the resonant frequency of the cabinet, less excitation may be caused based on the existing energy.

In the example of a woofer enclosure, the enclosure may be tensioned in such a way as to increase its resonant frequency outside the bandwidth of the woofer. If this happens, no energy may excite the resonance of the cabinet, thus rendering the cabinet substantially resonance free.

In some other cases, it may be not be practical or possible to place enough tension on the rod. For example, the amount of necessary tension might be enough to break or otherwise stress the enclosure. In a second embodiment, the frequency of the enclosure resonance is tuned using the damping rod to a frequency that is absorbed by the material of the enclosure. For example, the enclosure may be tuned to a frequency where the enclosure material is highly damping.

Alternatively, a piece of constrained layer damping material, or C.L.D material, may be placed underneath the washer 211, 212 or may act as the washer itself. The tightening may be carried out to place a sufficient amount of tension on the enclosure to match the frequency where the CLD may best absorb. Another embodiment may place damping material in the enclosure in a way to damp frequencies, and again may be tuned to match the best damping of the damping material.

Figure 2:
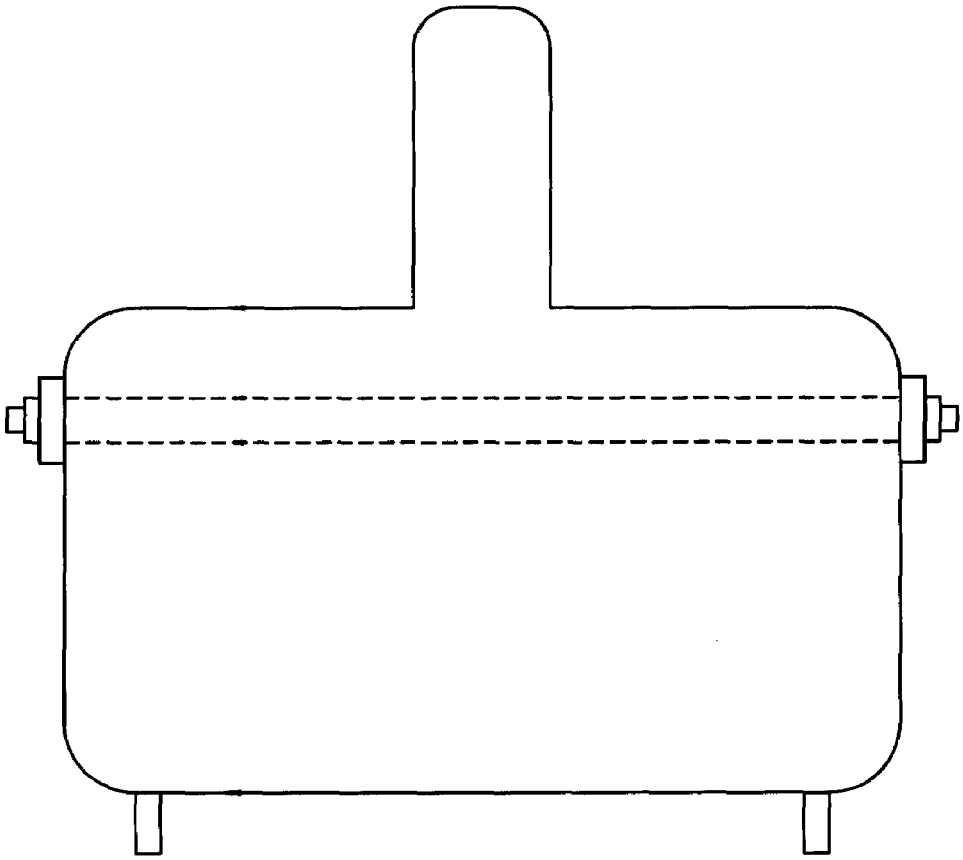
FIG. 2 shows the damping rod used with an engine.

The above has described using this technology for speaker enclosures. However, other applications of these damping devices may be used. They may be used in industrial machinery, in automobiles to adapt to engine vibrations, buildings, where support rods may operate to damp the effect of earthquakes, home appliances, and other audio and visual components such as televisions, amplifiers, receivers, and others. In each of these applications, the tensioning element may be attached between two facing surfaces, and tightened to increase the tension between the surfaces. FIG. 2 shows the damping rod used in an automobile engine. The rod may be placed at any location on the engine.

All such modifications are intended to be encompassed within the following claims, in which:

The invention claimed is:

1. A method, comprising: attaching a tunable damping element to a resonating element; and increasing an amount of tension in said resonating element to increase a resonant frequency of the resonating element in a way that decreases an effect of stimulated audio on the resonating element, wherein said tunable damping element includes a rod which is connected to said resonating element, and wherein said increasing includes tightening said tunable damping element, to increase an amount of tension in said resonating element, wherein said tightening comprises providing a washer on the rod, and tightening the washer against a surface of the resonating element, further comprising coupling a sound damping material to said washer.

2. A method as in claim 1, wherein said increasing comprises tuning the resonating element to a frequency related to characteristics of the sound damping material.

3. A method as in claim 2, wherein said characteristics include a maximum frequency of maximum sound absorption of the sound damping material.

* * * * *